US005364091A

United States Patent [19]

Sebek

[11] Patent Number: 5,364,091

[45] Date of Patent: Nov. 15, 1994

[54] SKILL BUILDING APPARATUS FOR BASKETBALL PLAYERS

[75] Inventor: Robert M. Sebek, 6528 Chestnut Grove La., Charlotte, N.C. 28210

[73] Assignee: Robert M. Sebek, Charlotte, N.C.

[21] Appl. No.: 96,544

[22] Filed: Sep. 8, 1993

[51] Int. Cl.[5] ..... A63B 63/08; A63B 69/00

[52] U.S. Cl. ..... 273/1.5 A

[58] Field of Search ..... 273/1.5 R, 1.5 A, 411

[56] References Cited

U.S. PATENT DOCUMENTS

| | | | |
|---|---|---|---|
| 1,778,173 | 10/1930 | Steele | 273/1.5 R |
| 2,085,206 | 6/1937 | Holmdahl | 273/1.5 R |
| 2,192,430 | 3/1940 | Branner | 273/1.5 R X |
| 2,534,067 | 12/1950 | Rubin | 273/1.5 R |
| 2,958,528 | 11/1960 | Wlkelund | 273/1.5 R |
| 2,999,233 | 9/1961 | Dresbach et al. | 273/1.5 R |
| 3,244,420 | 4/1966 | Poynter | 273/1.5 A X |
| 3,825,256 | 7/1974 | Ochi | 273/1.5 A |
| 3,825,257 | 7/1974 | Palmer | 273/1.5 A |
| 4,013,292 | 3/1977 | Cohen et al. | 273/1.5 R |
| 4,199,141 | 4/1980 | Garcia | 273/26 A |
| 4,333,657 | 6/1982 | Jaworski et al. | 273/376 |
| 4,546,973 | 10/1985 | Mouser | 273/1.5 R |
| 4,786,371 | 11/1988 | Postol | 273/1.5 A |
| 4,838,549 | 6/1989 | Woodall | 273/1.5 A |
| 4,869,502 | 9/1989 | Wares | 273/1.5 A |
| 4,951,944 | 8/1990 | Morgan | 273/1.5 R |
| 5,016,875 | 5/1991 | Joseph | 273/1.5 A |
| 5,035,423 | 7/1991 | Arciniega | 273/1.5 A |
| 5,171,009 | 12/1992 | Filewich et al. | 273/1.5 A |

FOREIGN PATENT DOCUMENTS 1105205 7/1984 U.S.S.R. .

*Primary Examiner*—William H. Grieb

[57] ABSTRACT

A skill building apparatus for basketball players includes a frame defining a substantially rectangular configured and enclosed cage in which a player stands substantially stationary. The frame includes a pair of spaced, longitudinally extending, parallel frame members extending along the length of the upper portion of the cage. A bridge assembly is mounted transverse on the parallel frame members and includes means for moving the bridge assembly longitudinally along the frame members. A basketball backboard and goal assembly is supported by the bridge assembly and a motor mechanism pivotally rotates the backboard and goal assembly about a vertical axis. Longitudinal movement of the bridge assembly and pivotal rotation of the backboard and goal assembly about the vertical axis are controlled by a microprocessor. A ball return mechanism is positioned under the backboard and goal assembly and bridge assembly, and the mechanism extends downwardly from one end of the enclosed cage to a ball return area positioned in close proximity to where a player stands within the enclosed cage for returning those balls shot at the basketball goal. The frame is formed as a collapsible unit to aid in mobile transport of the apparatus.

23 Claims, 11 Drawing Sheets 10
14
16
18
20
22
24
26
30
32
34
36
50
50a
50b
50c
90
92
94
96
120
122
124
3
4
7

SKILL BUILDING APPARATUS FOR BASKETBALL PLAYERS

FIELD OF THE INVENTION

This invention relates to a skill building apparatus for basketball players in which a basketball backboard and goal assembly are mounted on an overhead bridge assembly that longitudinally moves on a frame defining a substantially enclosed cage, and wherein the basketball backboard and goal assembly are pivotably rotatable about a vertical axis.

BACKGROUND OF THE INVENTION

Both professional and amateur basketball players enjoy practicing their shots, sometimes for many hours a session. Depending on whether a player is a professional or amateur, the player finds a gymnasium or playground, and often practices his shots alone. Much of the player's time is spent chasing balls, detracting from the player's practice session and his concentration on various shots and angles.

U.S. Pat. No. 5,035,423 discloses a basketball training facility in which a backboard and goal are mounted on a vertical pole within an enclosed room. The pole is mounted on a ground engaging platform which is movable toward and away from the player. The pole may be rotated to pivot the backboard and the goal about a vertical axis. An inclined ramp provides for a ball return surface toward the player positioned within the room. The pole moves through a slot formed in the inclined ramp.

Although this proposal does allow a player to practice various shots from one position, the apparatus is limited because it does not provide for a preprogrammed sequence of backboard and goal movement which would provide for a more efficient practice routine. Additionally, the construction of the disclosed apparatus: 1) does not provide for efficient longitudinal movement and rotation of the goal and backboard because the platform is supported by ground engaging slider blocks set on parallel rails; 2) does not provide for a means to keep track of successful and unsuccessful shot attempts; 3) does not provide for efficient ball return directly to the player; and 4) is not mobile for movement of the apparatus from one location to another location.

SUMMARY OF THE INVENTION

It is therefore an object of the present invention to provide a skill building apparatus for basketball players and the like in which the backboard and goal assembly are longitudinally and rotatably movable, and wherein the backboard and goal assembly are supported on and move along an overhead support system.

It is another object of the present invention to provide a skill building apparatus for basketball players and the like in which the backboard and goal assembly are longitudinally and rotatably movable, and wherein the apparatus provides for a preprogrammed sequence of backboard and goal assembly movement to permit a desired practice routine.

It is another object of the present invention to provide a skill building apparatus for basketball players and the like in which the backboard and goal assembly are longitudinally and rotatably movable, and which overcomes the aforementioned disadvantages of the proposed constructions.

In accordance with the present invention, a skill building apparatus for basketball players provides for more efficient movement of the backboard and goal assembly by providing an overhead bridge assembly for moving the backboard and goal assembly and a microprocessor for allowing a preprogrammed practice sequence for the player.

The apparatus includes a frame defining a substantially rectangular configured and enclosed cage in which a player stands substantially stationary in a ball throwing position. The frame includes a pair of spaced longitudinally extending, parallel frame members extending along the upper portion of the cage and substantially along the length of the cage.

A bridge assembly is mounted transverse on the parallel frame members and includes means for moving the bridge assembly longitudinally along the frame members. A basketball backboard and goal assembly are supported on the bridge assembly, and means pivotally rotate the basketball backboard and goal assembly about a vertical axis. A microprocessor controls longitudinal movement of the bridge to and from the player and controls pivotal rotation of the goal about the vertical axis.

A ball return is positioned under the longitudinally extending frame members, the bridge assembly, and the backboard and goal assembly. The ball return extends downwardly from one end of the enclosed cage to a ball return area positioned in close proximity to where a player stands within the enclosed cage for returning balls shot at the basketball goal to the player.

In the preferred embodiment, the apparatus has upper frame members which include vertically oriented C-channel tracks. The bridge assembly includes idler wheels positioned within the C-channel tracks. An electric stepper motor and chain transmission mechanism interconnect the motor and bridge assembly for moving the bridge upon actuation of the motor.

Sensor means detects balls shot at the goal and the number of balls successfully thrown through the goal. Means records the number of unsuccessful and successful shots and means displays to the user the record of successful and unsuccessful shots.

The frame forming the enclosed cage comprises tubular vertical column members and horizontal cross members. An open-mesh fabric netting covers the frame. The upper frame members upon which the bridge assembly is mounted includes hinged joints to permit the frame to be collapsed upon itself to facilitate storage and movement.

In the preferred embodiment the ball return means comprises an open-mesh fabric netting suspended within the enclosed frame. The ball return means further comprises a ball return hopper positioned at a low area defined by the open-mesh fabric netting and into which balls are deposited after rolling down the open-mesh fabric netting.

The means for pivotally moving the backboard and goal about a vertical axis includes a pintle and gudgeon assembly. The bridge assembly includes downwardly extending frame members on which the pintle and gudgeon assembly are mounted.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENT

Figures 1, 2, 3:
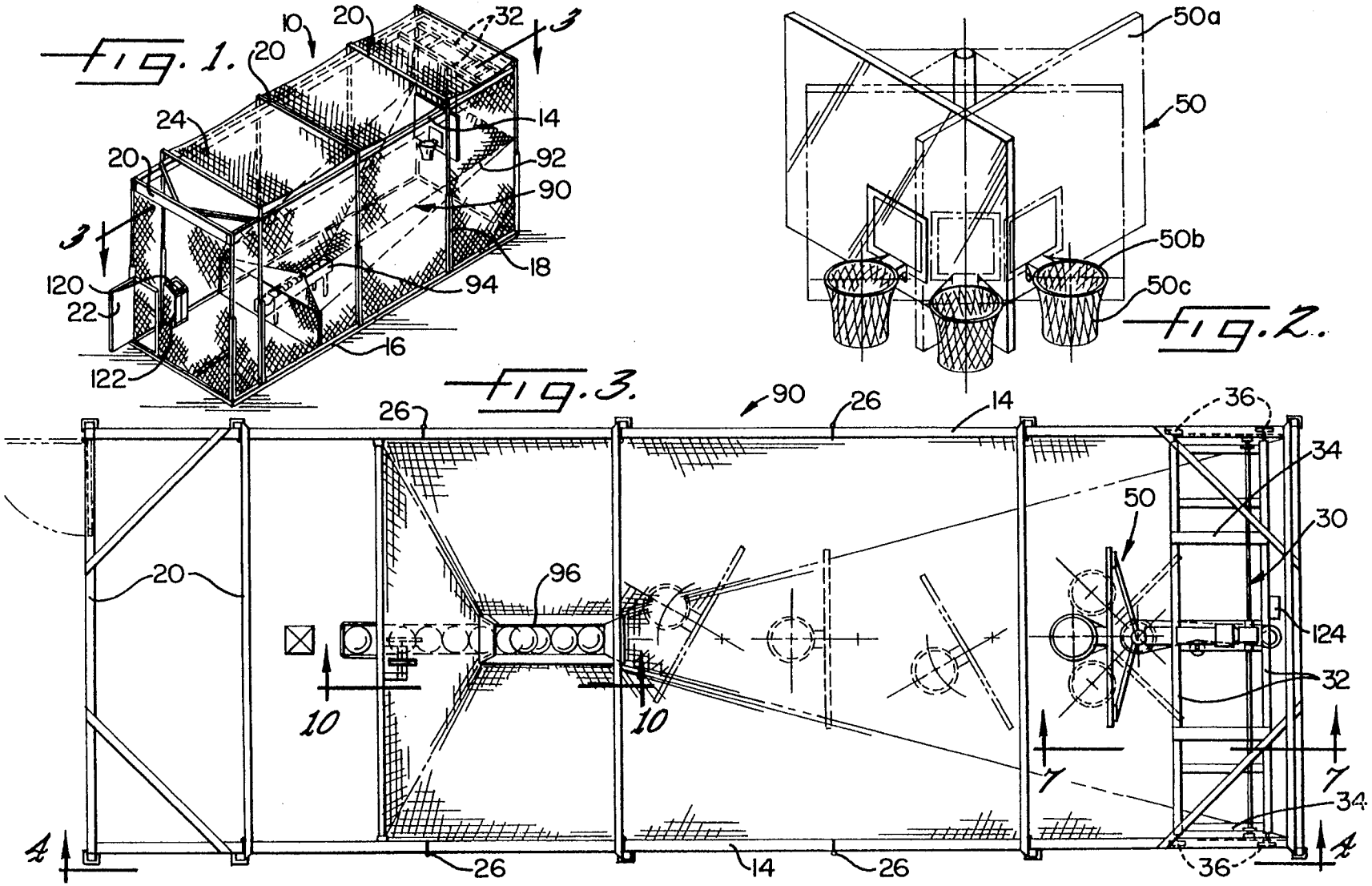
FIG. 1 is a perspective view of the skill building apparatus of the present invention.
FIG. 2 is a diagrammatic view of the pivoting rotation of the backboard and goal assembly in accordance with the present invention.
FIG. 3 is a plan view taken along line 3—3 of FIG. 1.

Referring now to the drawings and more particularly to FIG. 1, there is disclosed the skill building apparatus for basketball players in accordance with the present invention. The skill building apparatus 10 of the invention includes a frame 12 (FIGS. 13 through 16), which defines a substantially rectangular and enclosed cage in which a player stands substantially stationary at a ball throwing position 13 during skill building practice routines. The frame 12 includes respective upper and lower sets of parallel frame members 14 and 16. Upper and lower sets of parallel frame members 14 and 16, are secured in spaced relation to each other by vertical support members 18 and horizontally extending support members 20.

Figure 15:
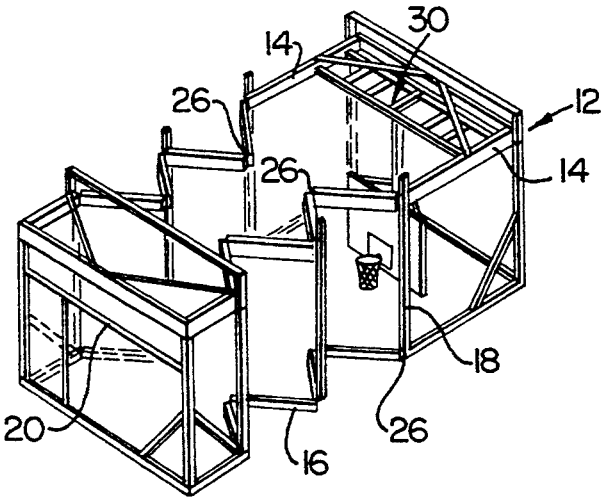
Figure 16:
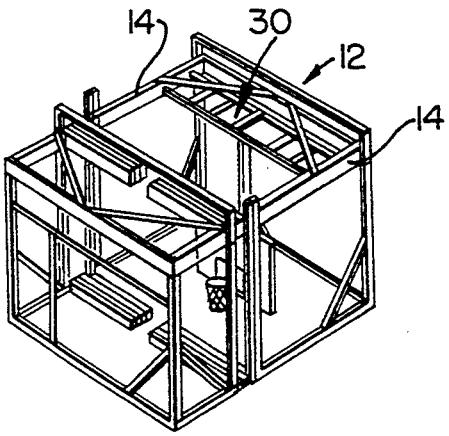

A vertical support member 18 and horizontal support member 20 are positioned at the one end of the formed cage and form a doorway (FIG. 1). An open mesh fabric netting 24 covers the horizontal and vertical support members 18 and 20 to enclose the frame 12 and form an enclosed cage through which ingress to and egress from may only be accomplished by means of the door 22. In the preferred embodiment both vertical and horizontal support members 18, 20 are tubular configured to add strength. The support members are attached to upper and lower frame members 14, 16 by fabrication techniques known to those skilled in the industry. The vertical tube members 18 can be formed as upper and lower coaxial tubes as shown in FIG. 1 to aid in collapsibility and mobility. Both the upper and lower frame members 14, 16, include a plurality of hinged joints 26 for permitting the frame 12 to be collapsed upon itself to facilitate movement and storage to a desired location (FIGS. 15 and 16).

Figure 9:
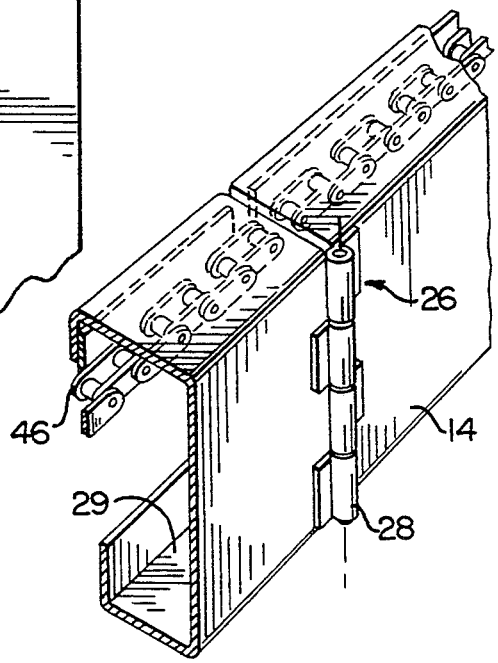
FIG. 9 is an enlarged view of the upper frame member showing the pivoting interconnection of frame components at the joint.

FIG. 9 shows one preferred construction of the upper frame members 14. The upper frame members 14 are formed from a plurality of C-shaped channel members which are connected at their ends by pivot pin joints 28. The joints 26 are formed on opposite sides of every other joint so that the frame 12 can be collapsed in accordion style as shown in FIGS. 15 and 16. As illustrated, the C-shaped upper frame member 14 includes a vertically oriented, formed roller channel 29 into which rollers may be positioned. The lower frame member 16 is a straight frame member that includes similar pivot pin joints.

Figure 4:
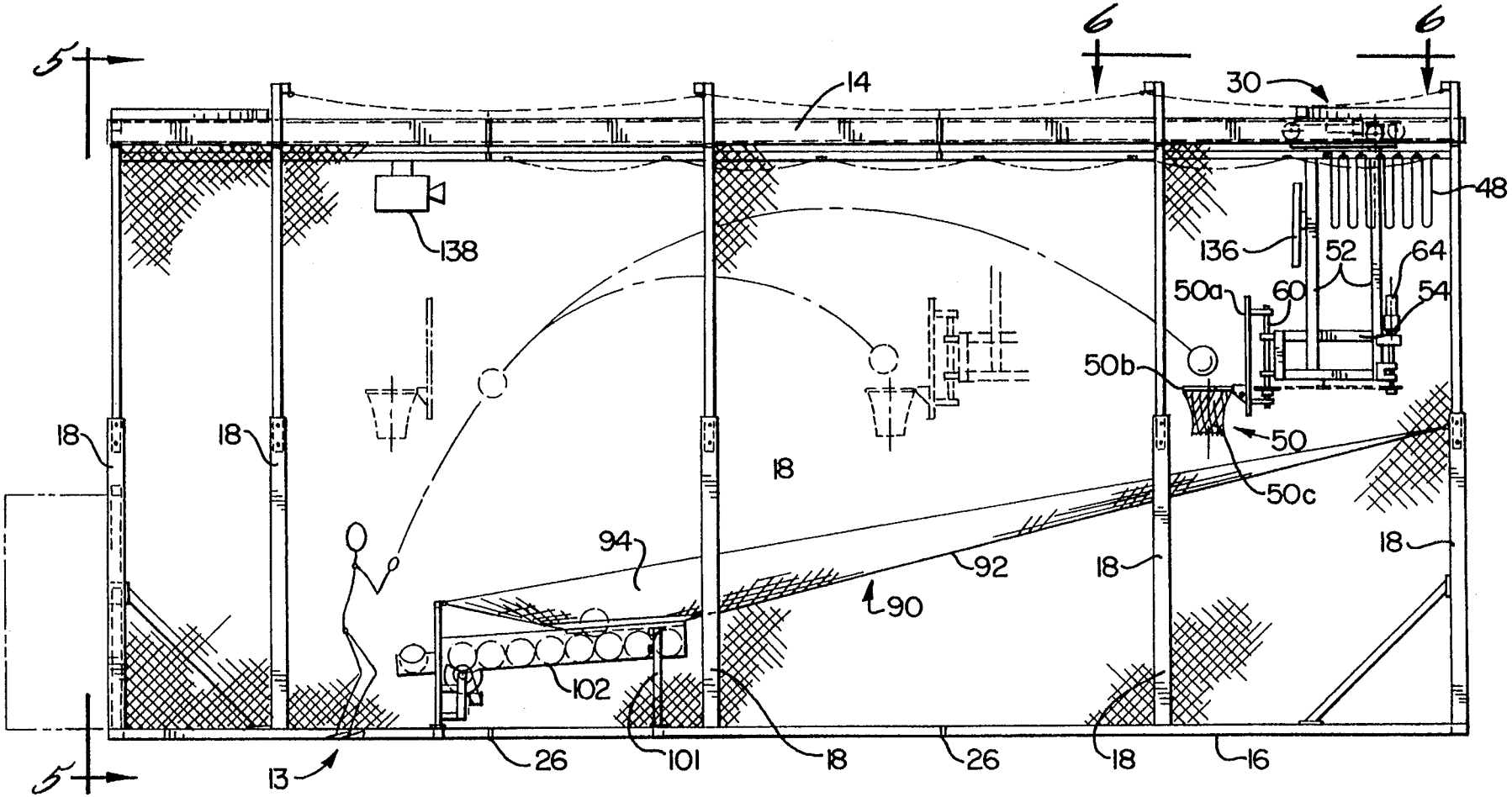
FIG. 4 is a side elevation view of the apparatus taken along line 4—4 of FIG. 3.

As shown in FIGS. 1 and 4, a bridge assembly, indicated generally at 30, is mounted transverse on the upper parallel frame members 14. The bridge assembly 30 includes two transverse bridge assembly frame members 32 extending across the width of the formed cage. The transverse bridge assembly frame members are interconnected by support beams 34. An idler roll 36 is rotatably secured at the end of each bridge assembly frame member 32. Each idler roll 36 is positioned within the formed channel 29 of the upper frame members 14 to allow longitudinal movement of the bridge assembly 30 along the upper portion of the cage.

The bridge assembly 30 carries an electric stepper motor 40. The electric stepper motor 40 interconnects a transmission gear box 41. A driving shaft 42 extends into the transmission gear box 41, and extends transverse along the width of the bridge assembly 30. The ends of the shaft 42 include sprockets 44 positioned within the channel 29. A chain drive transmission 46 extends through the formed channel of the upper frame member 14, forming a fixed loop. The drive sprockets 44 positioned within the channel 29 interconnect the chain similar to a rack and pinion system. Actuation of the electric stepper motor 40 drives shaft 42 and sprockets 44 to allow movement of the bridge assembly 30. As the bridge longitudinally moves along the upper portion of the cage, the power cable 48 supplying power to the electric stepper motor 40 is extended in accordion style as shown in FIG. 4. When the frame is collapsed for movement, master links in the chain are removed and thus, the chain does not have to be removed from the frame during collapse.

Figure 7:
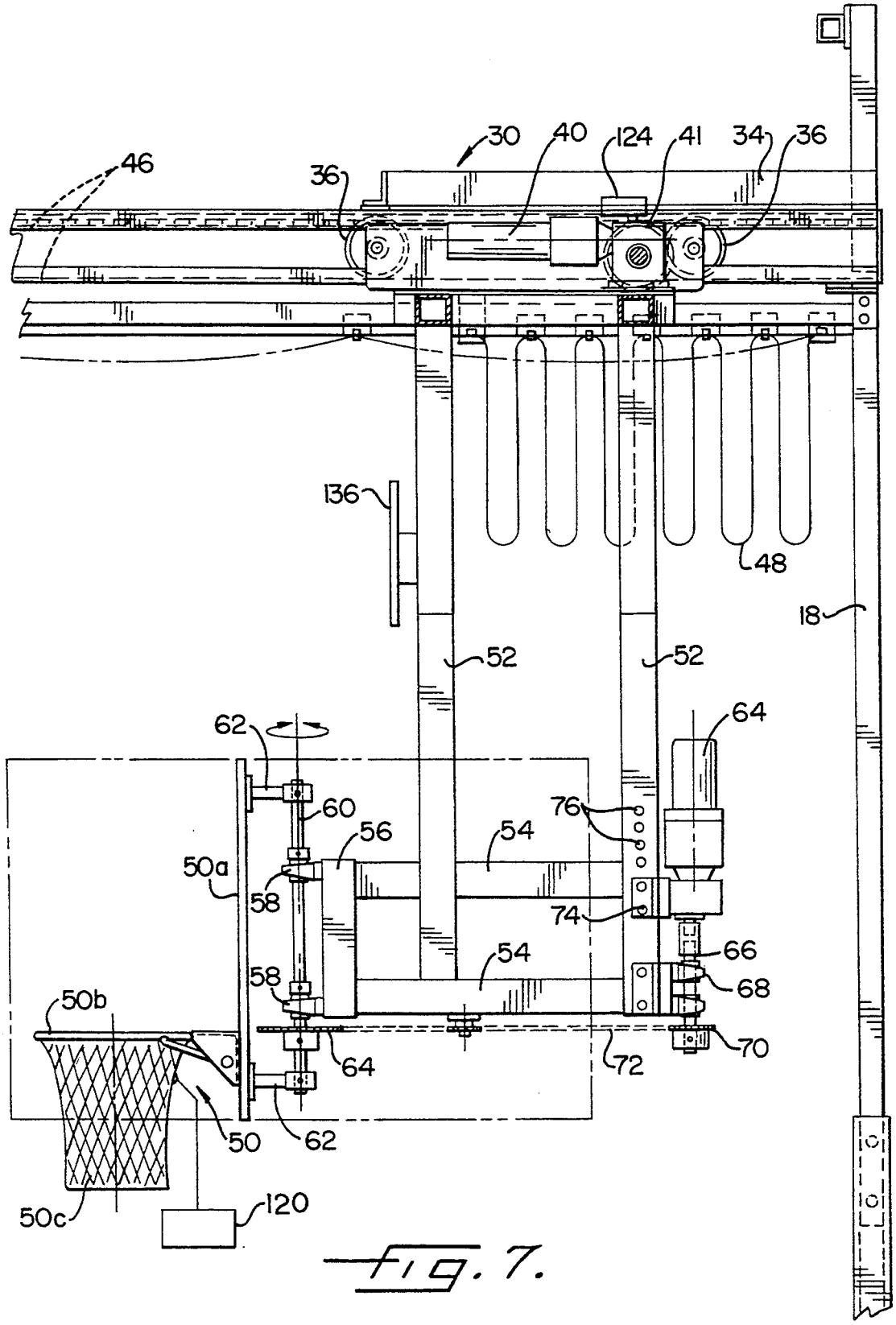
FIG. 7 is a side elevation view of the apparatus taken along line 7—7 of FIG. 3.
Figure 8:
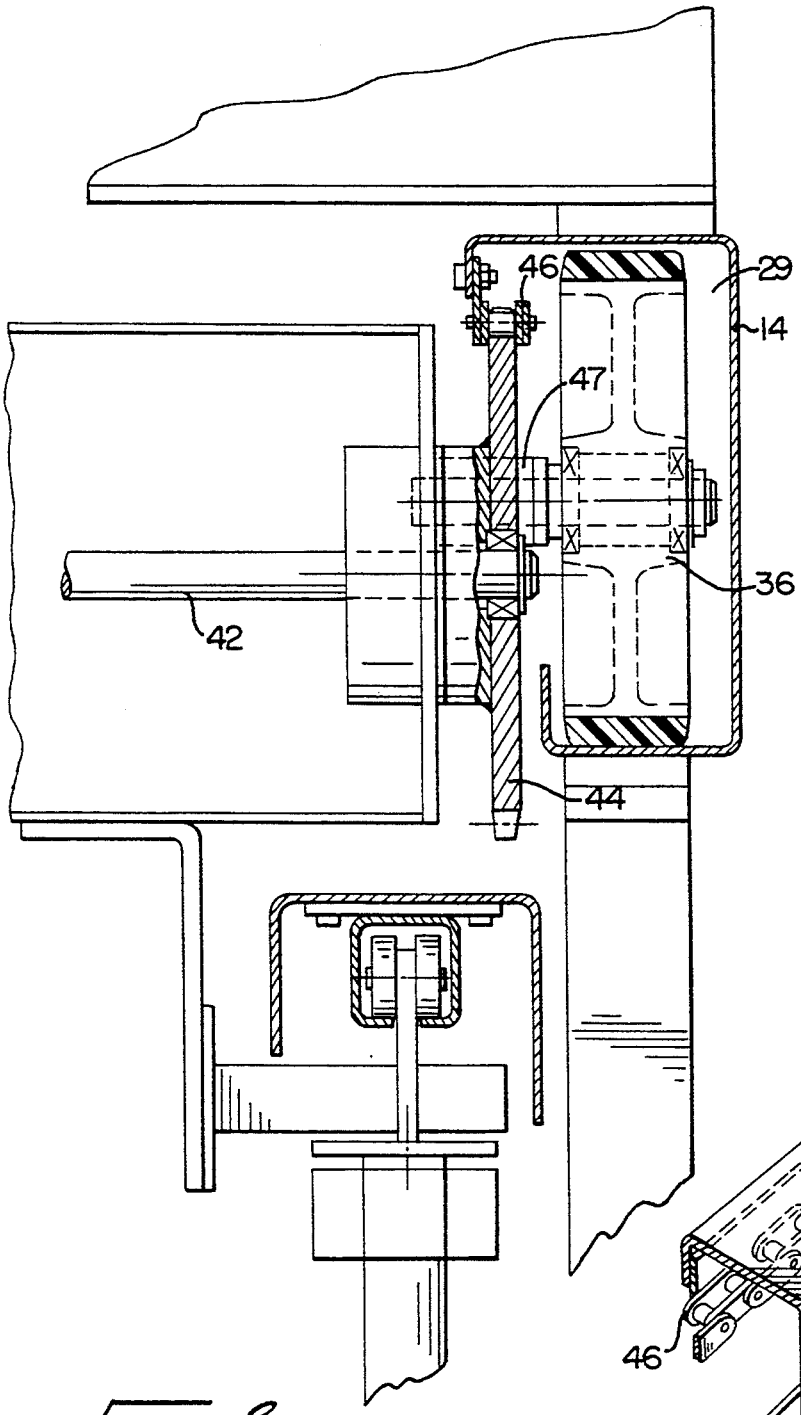
FIG. 8 is a sectional view taken along line 8—8 of FIG. 6.

A basketball backboard and goal assembly, indicated generally at 50, are supported by the bridge assembly 30. The assembly 50 includes a backboard 50*a*, a goal 50*b* secured to the backboard and extending outward therefrom, and a net 50*c* extending downward from the goal 50*b*. As best shown in FIG. 7, two vertical support members 52 extend downward from the bridge assembly 30. Transverse and horizontally extending support members 54 extend forward from the vertical support members 52. The backboard and goal assembly 50 are supported by means of an assembly similar to a pintle and gudgeon type of assembly. A support plate 56 is connected at the end of the horizontally extending support members 54. The support plate 56 includes a journal assembly 58 in which a vertical support pole 60 is supported. The backboard and goal 50 are mounted to the pole 60 by means of support brackets 62.

The lower end of the pole 60 includes a sprocket 64 mounted below the horizontally extending support members 54. An electric stepper motor 66 is mounted onto one of the downwardly extending support members 52, and includes an output shaft 66 supported by journal supports 68. The lower end of the output shaft 66 includes a sprocket 70. Sprockets 70 and 64 are interconnected by chain transmission 72. Actuation of stepper motor 64 drives chain transmission 72 and permits pivotal, rotational movement of the backboard and goal assembly 50 along the vertical axis defined by the pole 60.

The basketball backboard and goal assembly 50 is preferably movable relative to the bridge assembly 30. In one embodiment the frame members 54 may be moved relative to the frame members 52. Pins 74 interconnecting the frame members 52, 54 are removed, and the frame member 54 is moved upwardly to other positioning holes 76, and the pin 74 inserted therein for retaining the frame members together.

In another embodiment, the pole 60 is formed as a multi-part pole. The pole 60 has upper and lower coaxial sections. These sections form an outer pole which is rotatable by means of a sprocket and drive transmission as described before. The pole may include an inner pole which telescopes up and down inside the outer pole. The inner pole telescopes in response to movement of a drive gear along a track on the inner pole when driven by an electric motor and gear mounted on the outer pole. Positioning may be accomplished by a manual on-off switch. FIG. 2 only discloses 90° of relative movement. The backboard and goal assembly can rotate up to 180°.

Figures 10, 11:
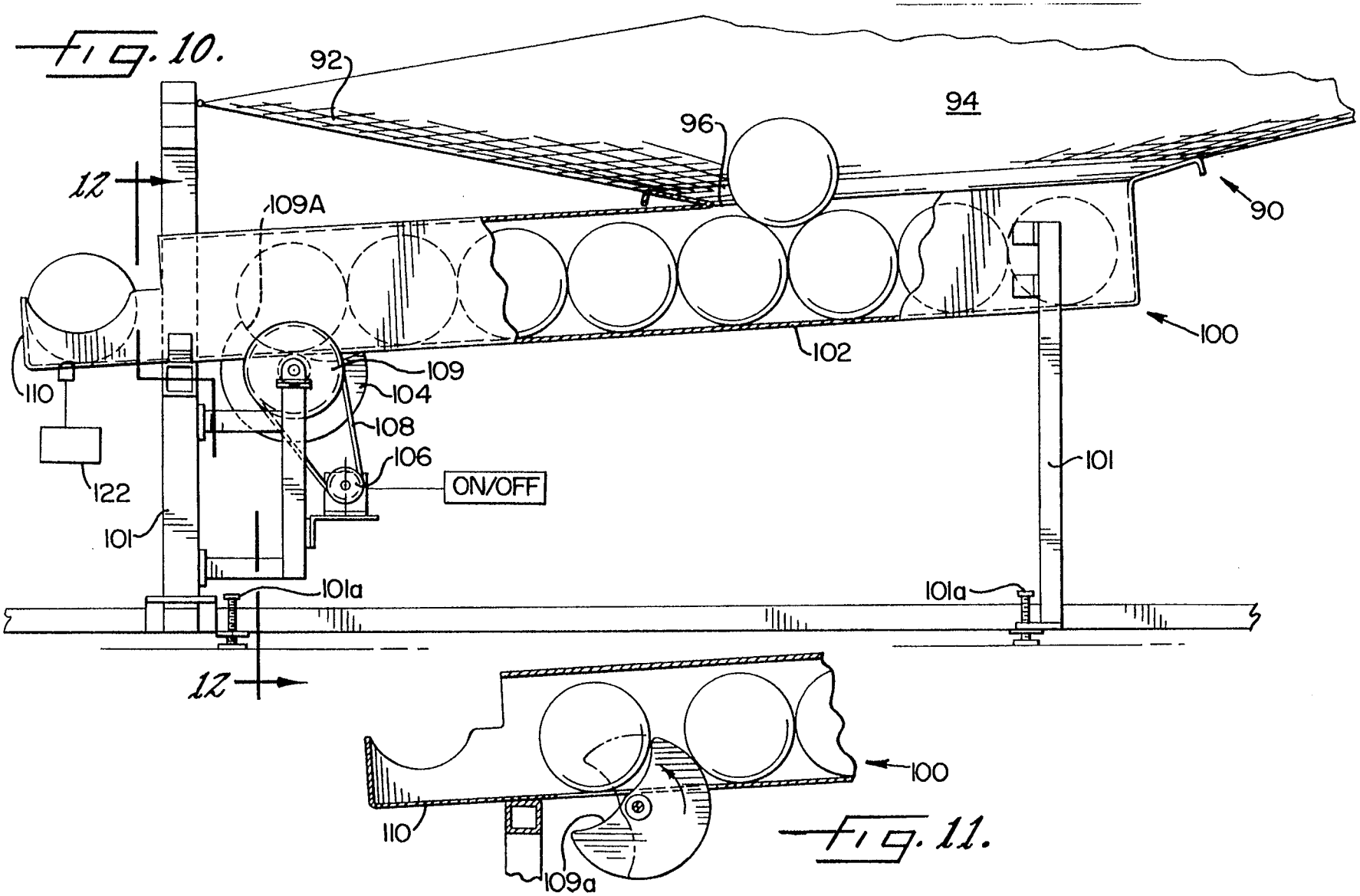
FIG. 10 is a sectional view taken along line 10—10 of FIG. 3.
FIG. 11 is an enlarged diagrammatic view of the ball feed mechanism in accordance with the present invention.
Figure 12:
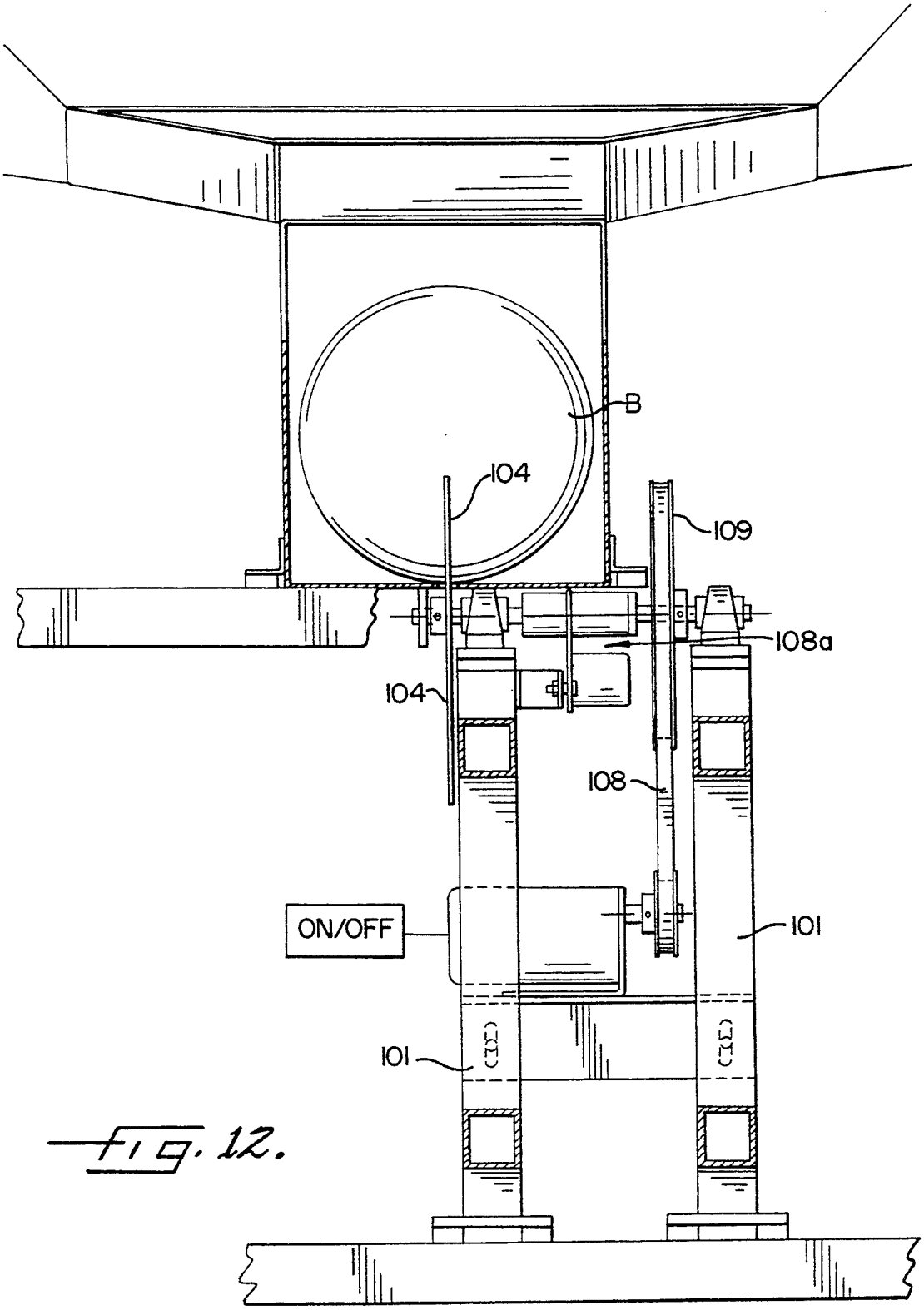
FIG. 12 is a sectional view taken along line 12—12 of FIG. 10.
Figure 13:
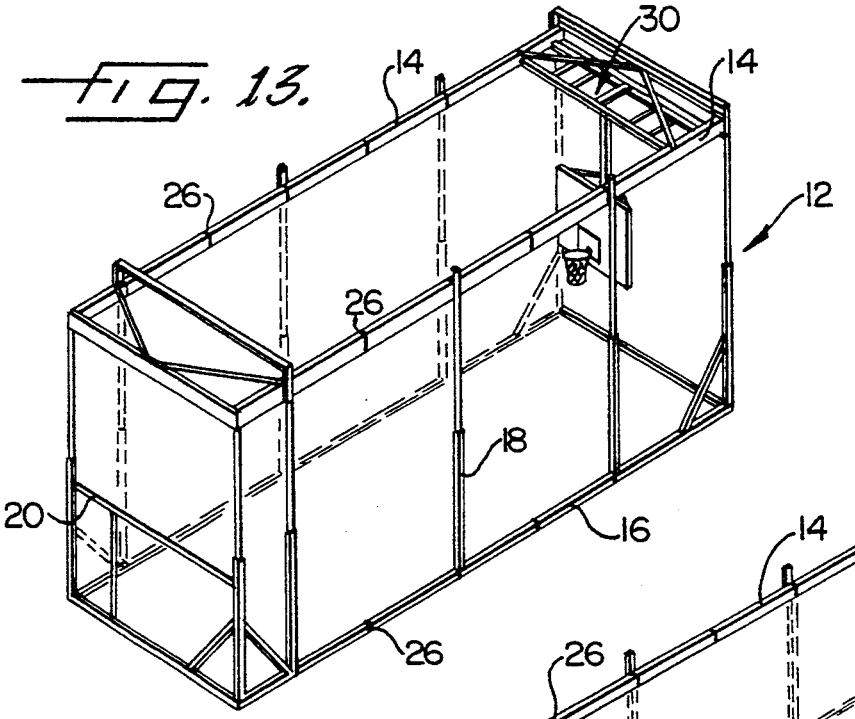
FIGS. 13 through 16 are views of the frame in various stages of its collapse to a more portable state.
Figure 14:
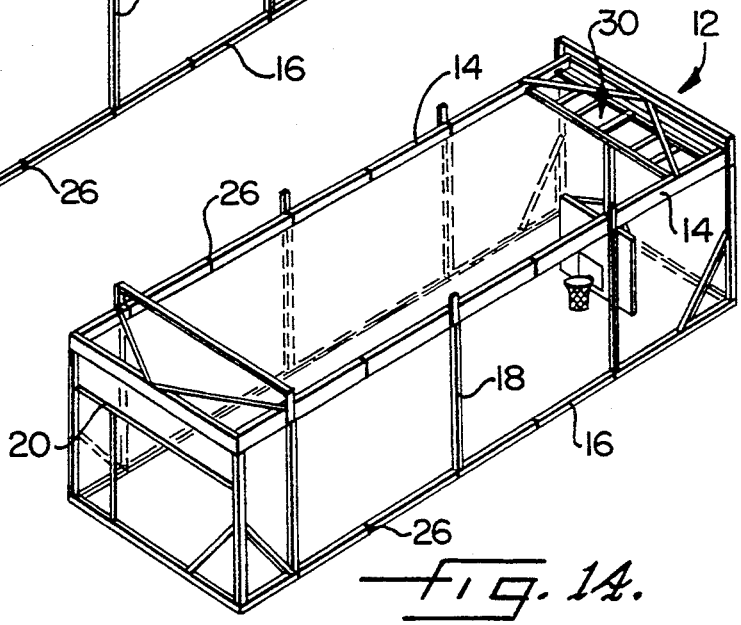

In accordance with the present invention, a ball return mechanism, indicated generally at 90, (FIGS. 3, 4 and 10) is positioned under the longitudinally extending frame members 14 and the backboard and goal assembly 50. The ball return mechanism extends downwardly from one end of the enclosed cage to a ball return area positioned in close proximity to where a player stands at the ball throwing position for returning balls shot at the basketball goal to the player. The basketball return mechanism 90 includes a open mesh fabric netting 92 supported at one end of the frame opposite from the door 22 and ball throwing position. The netting 92 extends downward and is suspended within the enclosed cage in a substantially concave configuration having a low area forming a central lower portion 94 (FIGS. 1 and 10).

The netting 92 has an opening 96 at the lower portion 94 through which balls drop downward into a hopper assembly indicated generally at 100. The hopper assembly 100 includes a downwardly inclined chute 102 mounted on ground engaging supports 101. The balls roll downward to a circular formed receiving member 104 (FIGS. 10 and 11). The receiving member 104 is pivotally mounted on one of the chute support members 101. An electric motor 106 and belt transmission 108 interconnect a sprocket 109 secured to a speed reduction mechanism **108*a* and the ball receiving member 104. Upon actuation of the motor 106, the ball receiving member 104 is rotated and a ball positioned in the chute 102 is moved into a cut-out 109*a* of the ball receiving member 104 and transferred into the ball discharge end 110 of the chute 102 to facilitate easy access to the ball by the player. The ball return mechanism 90 is secured to the ground via pins 101*a*, which extend into the lower portion of the ground engaging members 101 and into the ground. Upon removal of the pins, the mechanism 90 is readily movable, such as when the frame is collapsed. In the present invention, the motor is programmed to actuate when a ball is withdrawn from the ball discharge end 110**, thus always providing a ball at that end.

In accordance with the present invention, a microprocessor 120 is contained in a microcomputer casing and keyboard unit 122, and is operatively connected to each of the motors 40, and 64 to control movement of the bridge assembly and backboard and goal assembly. The microprocessor 120 is programmable by a player or his coach to allow a preprogrammed practice routine for the player. A large number of various conventional microprocessors and other conventional microprocessor hardware may be used for the present invention.

Figure 6:
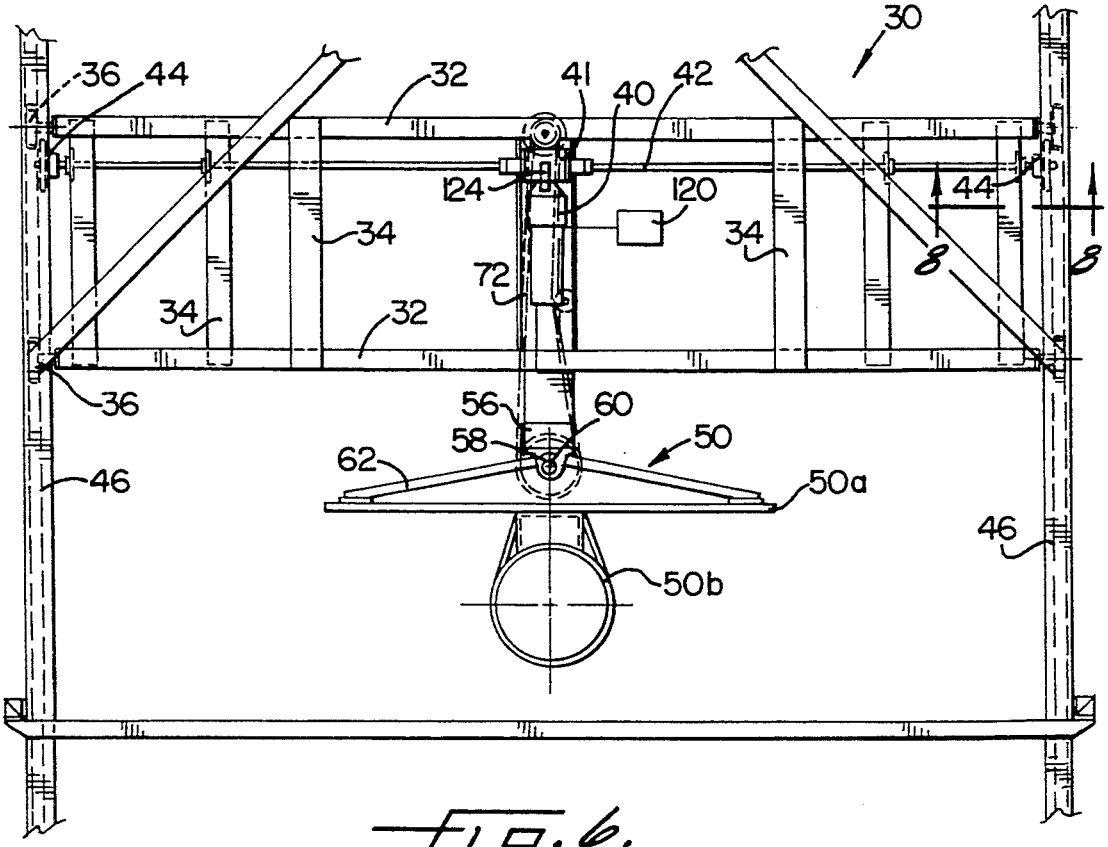
FIG. 6 is a plan view of the apparatus taken along line 6—6 of FIG. 4.

In the preferred embodiment, the bridge assembly stepper motor and transmission include an encoder 124, also operatively connected to the microprocessor 120 (FIG. 6). The encoder 124 registers position of the bridge assembly 30 relative to the frame. Through use of the encoder, a desired home position is established and all positions of the bridge assembly 30 along its longitudinal movement are known and maintained by the microprocessor 120. Additionally, the microprocessor outputs signals to a stepper motor 40 to move the bridge assembly 30 a predetermined amount in accordance with a preferred, preprogrammed practice routine. The electric stepper motor 64 of the backboard and goal assembly 50 also includes an encoder 126 operatively connected to the microprocessor to maintain control over the rotational movement of the backboard and goal assembly 50.

Additionally, a sensor 130 is positioned at the ball discharge end 110 (FIG. 10) and a second sensor 132 is positioned on the net **50*c* extending from the goal 50*b*. The microprocessor 120 is operatively connected to the sensors 130, 132 and maintains a record of the number of balls shot during practice as well as the number of balls that are successfully shot through the goal 50*b*. Whenever a ball is taken from the chute 102, the sensor 130 outputs a signal to the microprocessor 120. If the ball is successfully passed through the net 50*c*, the sensor 132 outputs a signal to the microprocessor 120** to register a complete and successful throw.

Figure 5:
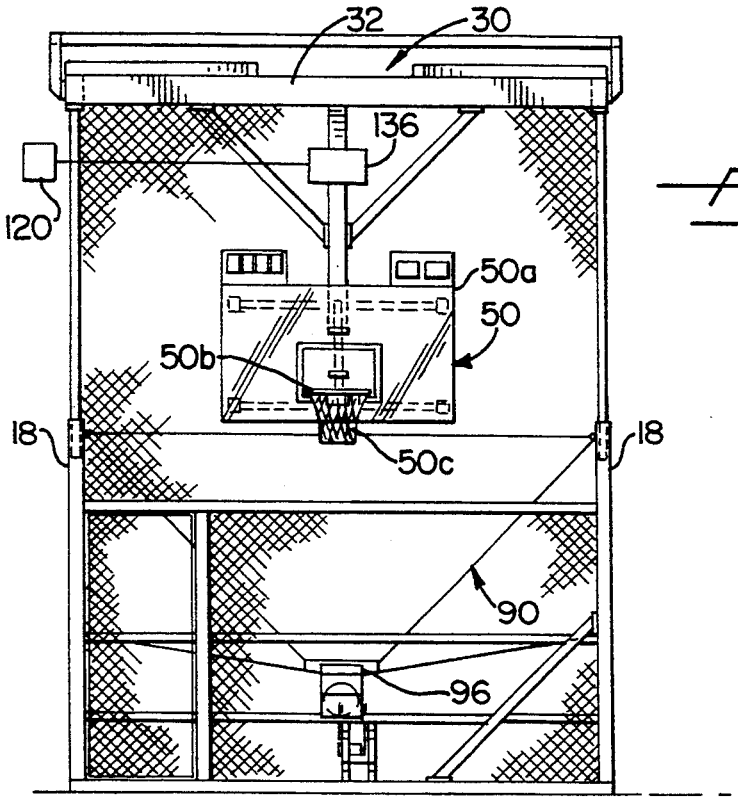
FIG. 5 is a front elevation view of the apparatus taken along line 5—5 of FIG. 4.

In the preferred embodiment, the microprocessor 120 is operatively connected to an LED score board 136 (FIG. 5) which displays the successful and unsuccessful throws to the player. In another preferred embodiment, the microprocessor operatively connects to speakers 138 which provide audio sound to the player during practice such as the boos, hisses, cheers and other sounds normally accompanying play.

The present invention can be designed for use with professional, college, high school or amateur players. For professional players, the microprocessor 120 is preprogrammed to move the bridge assembly and pivot the backboard and goal assembly into predetermined positions during a practice session. Alternatively, the player can preprogram the microprocessor 120 to move the bridge assembly and backboard and goal assembly to a desired position during practice. The microprocessor 120 can also be activated by coins or other tokens for recreational use. Conventional coin operated mechanisms commonly available in the market can be used.

Figure 19:
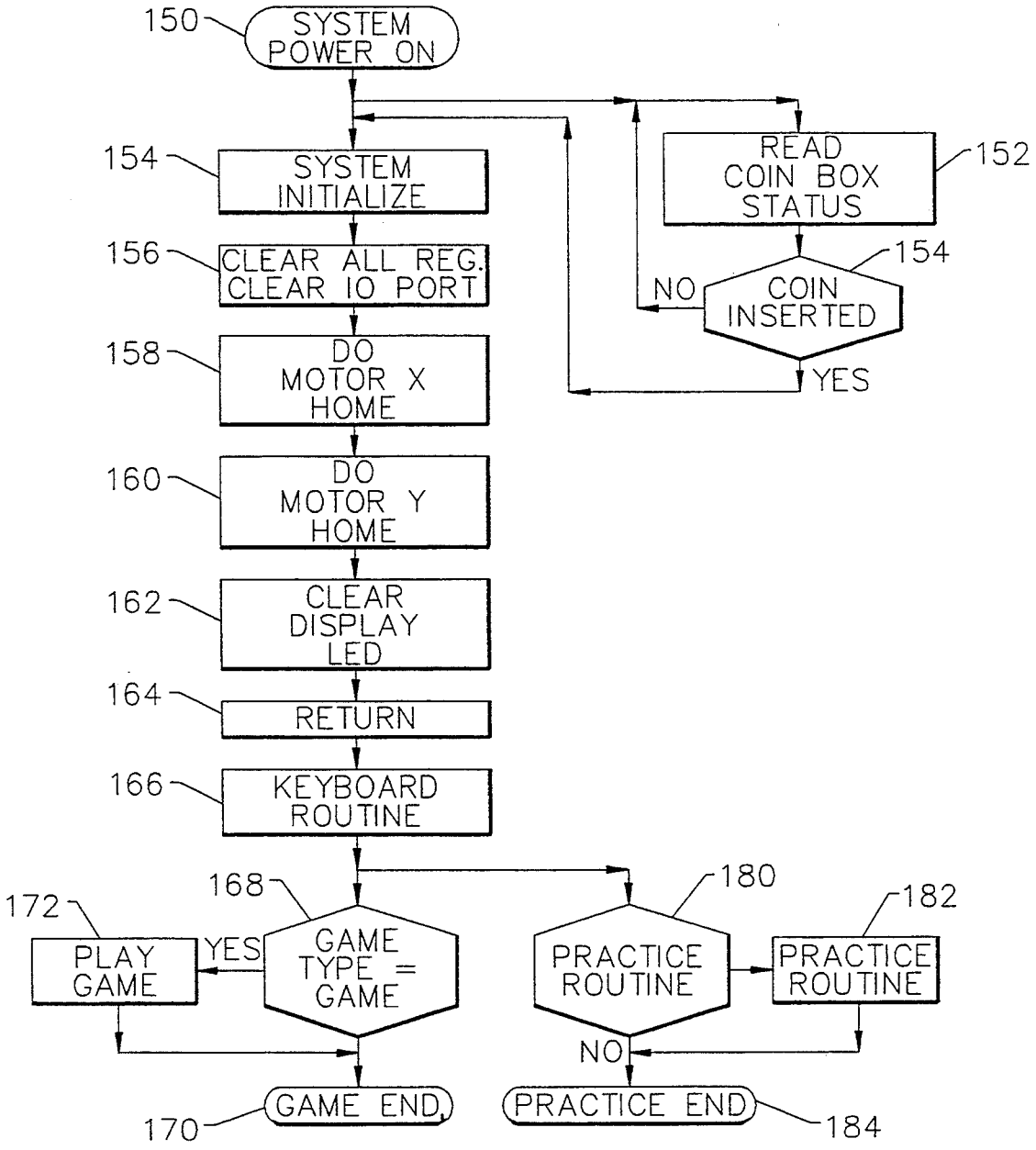
FIG. 19 is a flow chart of one method of initializing starting operation of the skill building apparatus.

Referring now to FIG. 19, one method of initializing starting operation of the apparatus is illustrated. At the start of initializing, the power is turned on (Block 150).

If the apparatus is the amusement embodiment used at carnivals and the like, the coin box status is read (Block 152) to determine if a coin has been inserted within the coin box (Block 154). If the coin has not been deposited, the "read" coin box status is maintained until a coin is deposited. Once a coin is deposited, the system begins initialization. In the embodiment used with professional, college, and high school sports, after power is turned on, the system is initialized.

At system initialization (Block 154), both the microprocessor registers, and input-output ports are cleared (Block 156). The microprocessor generates signals to the electric stepper motors to move the bridge assembly 30 and the basketball and goal assembly 50 to the home positions (Blocks 158 and 160). The LED's of the display board and monitor are cleared (Block 162). The return is hit on the control panel (Block 164), and a preferred keyboard routine is entered corresponding to a desired game or practice routine (Block 166). In the amusement embodiment, certain game types may be entered (Block 168). If no game is entered the game is ended (Block 170). After the game type is entered, the game is played (Block 172).

In the professional, college, and high school embodiments of the invention, the desired practice routine may be entered either by the player, or the coach (Block 180). The practice routine is begun (Block 182), and during play, the microprocessor maintains count of the successful and unsuccessful shots, and maintains a record for each player. The practice is ended (Block 184) when the practice routine is completed. If no practice routine is initially entered, the system initialization ends.

Instead of a read coin box status as in the amusement embodiment, in the professional, college, and high school embodiments of the present invention the microprocessor may require that the players input their name. System initialization will not begin until the players enter their names.

Figure 17:
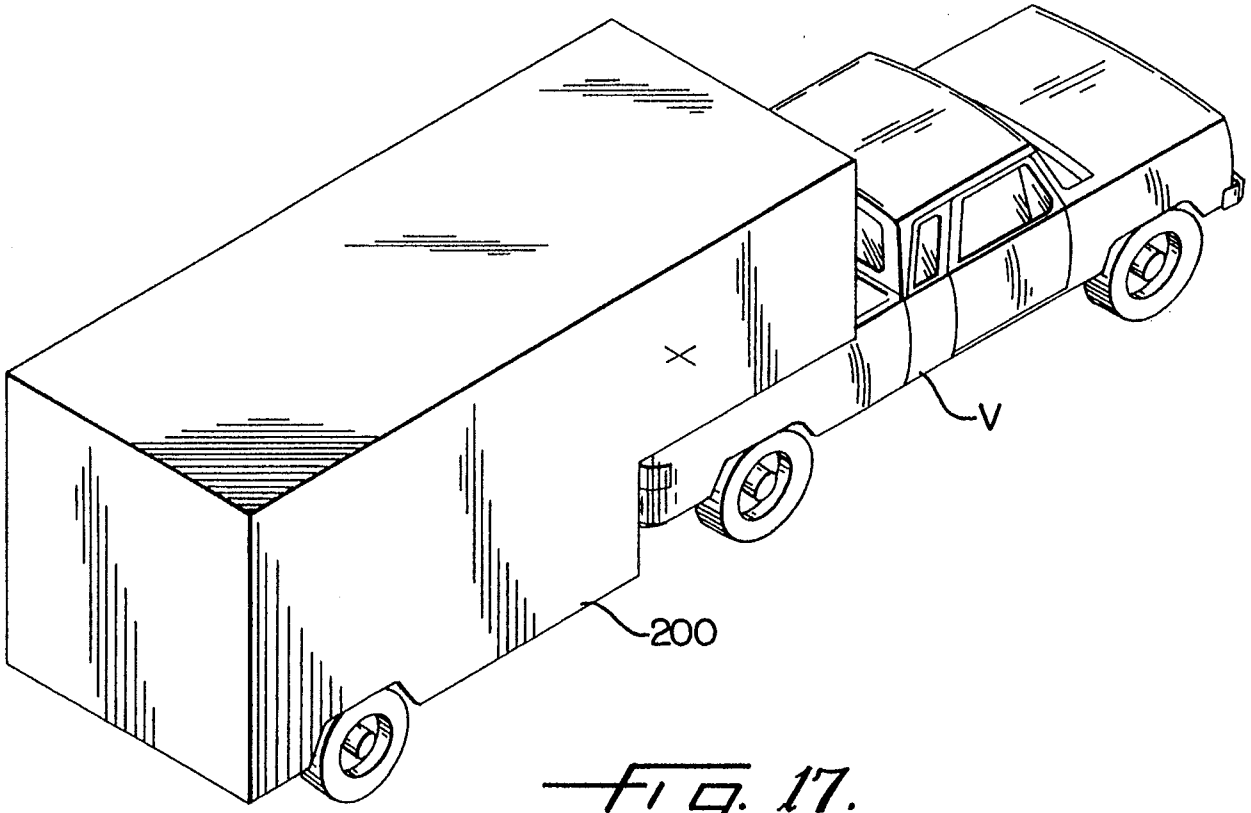
FIG. 17 is an isometric view of a trailer having the apparatus of the present invention contained therein for forming a portable, mobile unit.
Figure 18:
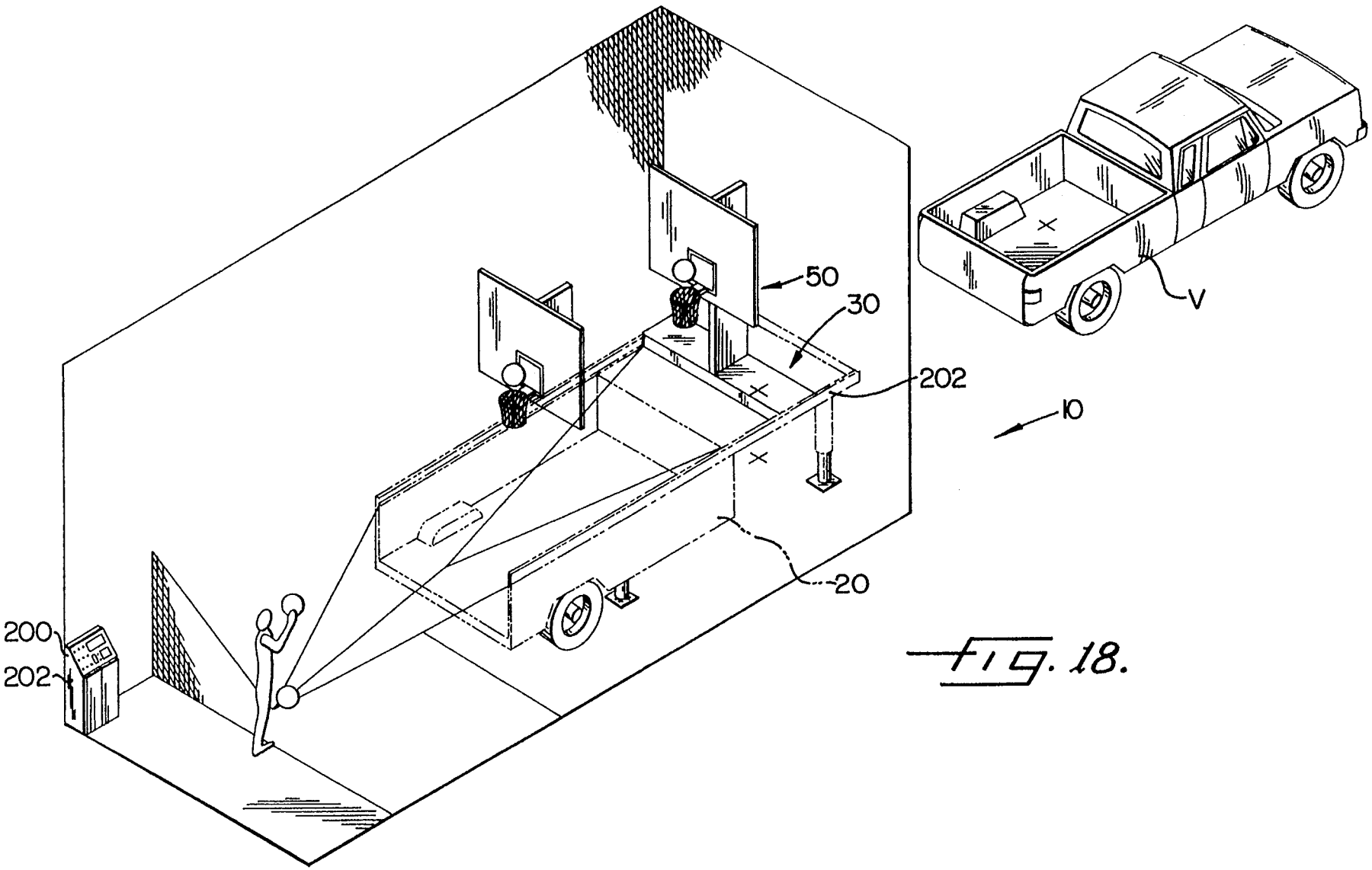
FIG. 18 is a schematic isometric view of the trailer and showing one proposed construction of the mobile apparatus in a working condition.

Referring now to FIGS. 17 and 18, a mobile unit for the skill building apparatus in accordance with the present invention is illustrated. In accordance with this one embodiment, the apparatus 10 is contained within a trailer 200 adapted to be connected to a vehicle V (FIG. 17). As shown in FIG. 18, the bridge assembly is mounted on rails 202 secured on the interior portion of the trailer 200. The trailer may be open-topped, having a tarpaulin covering the interior portion and apparatus. Other components are removed from the trailer and set-up as required. The bridge assembly may move on the rails in the same manner as described before. Additionally, the basketball backboard and goal assembly can be supported in a similar manner as described before.

In the drawings and specification, there has been set forth a preferred embodiment of the invention, and although specific terms are used, they are used in a generic and descriptive sense only, and not for purposes of limitation.

That which is claimed is:

1. A skill building apparatus for basketball players comprising a frame defining a substantially rectangular configured and enclosed cage in which a player stands substantially stationary therein at a ball throwing position, said frame including a pair of spaced, longitudinally extending, parallel frame members extending along the upper portion of the frame and substantially along the length thereof, a bridge assembly mounted transverse on the parallel frame members, means for moving the bridge assembly longitudinally along the frame members, a basketball backboard and goal assembly supported by the bridge, means for pivotally rotating the backboard and goal assembly about a vertical axis, means for controlling longitudinal movement of the bridge assembly to and from the ball throwing position and for controlling pivotal rotation of the backboard and goal assembly about the vertical axis, and ball return means positioned under the bridge assembly and the backboard and goal assembly and extending downwardly from one end of the frame to a ball return area positioned in close proximity to where a player stands for returning balls shot at the basketball goal to the player.

2. The apparatus according to claim 1 wherein the upper frame members include vertically oriented C-channel tracks, and wherein said bridge assembly includes idler wheels positioned within the C-channel tracks.

3. The apparatus according to claim 2 wherein said means for moving the bridge assembly longitudinally along the frame members includes an electric motor, a shaft and chain transmission, and means interconnecting the bridge assembly and shaft and chain transmission for longitudinally moving said bridge assembly upon actuation of said motor.

4. The apparatus according to claim 1 wherein said means for controlling longitudinal movement of the bridge assembly and for controlling pivotal rotation of the backboard and goal assembly about the vertical axis includes a microprocessor.

5. The apparatus according to claim 1 wherein said microprocessor is user programmable to move the bridge assembly and the backboard and goal assembly in a preprogrammed practice routine.

6. The apparatus according to claim 1 including means for detecting balls shot at the goal and the number of balls successfully thrown through the goal.

7. The apparatus according to claim 6 including means for recording the number of unsuccessful and successful shots and including means for displaying to the user the record of successful and unsuccessful shots.

8. The apparatus according to claim 1 wherein the frame forming the enclosed cage comprises tubular vertical column members and horizontal cross members, and an open mesh fabric netting covering the frame.

9. The apparatus according to claim 1 wherein the upper frame members upon which the bridge assembly is mounted include hinged joints to permit the frame to be collapsed upon itself to facilitate storage and movement.

10. The apparatus according to claim 1 wherein the ball return means comprises an open mesh fabric netting suspended within the enclosed frame.

11. The apparatus according to claim 10 wherein the open mesh fabric netting is suspended within the enclosed cage in a substantially concave configuration to form a low area, said low area having an opening through which balls fall through, and wherein said ball return means further comprises a ball return hopper positioned at the low area and into which balls are deposited after rolling down the open-mesh fabric netting.

12. The apparatus according to claim 11 including means for counting balls pulled from the hopper by the player.

13. The apparatus according to claim 12 wherein said means for pivotally rotating the backboard and goal assembly about a vertical axis includes a pintle and gudgeon assembly.

14. The apparatus according to claim 13 wherein said bridge assembly includes downwardly extending frame members on which the pintle and gudgeon assembly are mounted.

15. The apparatus according to claim 1 wherein said basketball backboard and goal are vertically movable relative to said bridge.

16. A skill building apparatus for a basketball player comprising a frame defining a substantially rectangular configured and enclosed cage in which a user stands substantially stationary therein at a ball throwing position, means mounting a basketball backboard and goal assembly within the cage, said mounting means including means for moving said basketball backboard and goal assembly toward and away from the ball throwing position, and for rotating the basketball backboard and goal assembly about a vertical axis, and microprocessing means operatively connected to said moving and rotating means for controlling longitudinal movement and rotation of said backboard and goal assembly into predetermined positions, and wherein said microprocessing means is user programmable to longitudinally move and rotate said backboard and goal assembly in a preprogrammed practice routine.

17. The apparatus according to claim 16 including means for detecting balls shot at the goal and the number of balls successfully thrown through the goal, and wherein said microprocessing means is operatively connected to said detection means for recording the number of unsuccessful and successful shots.

18. The apparatus according to claim 16 including means operatively connected to said microprocessing means for displaying to the player the record of successful and unsuccessful shots.

19. The apparatus according to claim 17 including means for creating an audio sound such as crowd cheers, wherein said audio sound means is operatively connected to said microprocessing means, and wherein said microprocessing means actuates said audio producing sound means in response to the successful and unsuccessful shots of the player.

20. The apparatus according to claim 16 including a mobile trailer adapted to be pulled by a vehicle, and wherein said mounting means is secured onto the bed of said trailer to aid in mobile transport of the apparatus from location to another location.

21. The apparatus according to claim 20 wherein said trailer includes longitudinally extending, parallel upper edges, and wherein said mounting means includes a bridge assembly mounted on the upper edges of the trailer, and wherein said backboard and goal assembly are mounted onto the bridge assembly.

22. A collapsible frame assembly for use with a skill building apparatus for basketball players and the like comprising upper and lower sets of parallel frame members, said upper set of frame members comprising vertically oriented, C-channel tracks, a plurality of vertical and horizontal support members interconnecting said upper and lower frame members to form a substantially rectangular frame structure, a bridge assembly mounted on said upper frame members, said bridge assembly including idler wheels positioned within said C-channel tracks to enable said bridge assembly to move back and forth along a substantial length of said frame, said bridge assembly including a basketball and goal assembly mounted thereon and extending downward into the interior defined by said frame, and wherein said upper and lower frame members both include a plurality of hinged joints for permitting the frame to be collapsed upon itself to facilitate movement and storage to a desired location.

23. A collapsible frame assembly according to claim 22 including an open mesh fabric netting covering said horizontal and vertical support members to enclose said frame structure and form an enclosed cage.

* * * * *